US005775573A

United States Patent [19]

Smith

[11] Patent Number: 5,775,573

[45] Date of Patent: Jul. 7, 1998

[54] COMPARTMENTALIZED DISPLAY TRAY WITH ERECTABLE PARTITIONS

[75] Inventor: Michael J. Smith, Orangeburg, N.Y.

[73] Assignee: Arrow Art Finishers, L.L.C., Princeton, N.J.

[21] Appl. No.: 723,827

[22] Filed: Sep. 30, 1996

[51] Int. Cl.[6] ..... B65D 25/04

[52] U.S. Cl. ..... 229/120.14; 229/120.24; 206/757

[58] Field of Search ..... 206/561, 734, 206/756, 757; 229/120.14, 120.15, 120.16, 120.22, 120.24

[56] References Cited

U.S. PATENT DOCUMENTS

| | | | |
|---|---|---|---|
| 2,711,852 | 6/1955 | Petter | 229/120.24 |
| 2,946,498 | 7/1960 | Williamson | 229/120.14 |
| 3,036,753 | 5/1962 | Davis et al. | 229/120.14 |
| 4,018,377 | 4/1977 | Kent et al. | 229/120.14 |
| 4,403,727 | 9/1983 | Grieve et al. | 229/120.15 |

FOREIGN PATENT DOCUMENTS

| | | | |
|---|---|---|---|
| 2498562 | 7/1982 | France | 229/120.24 |

*Primary Examiner*—David T. Fidei

*Attorney, Agent, or Firm*—Kirschstein, et al.

[57] ABSTRACT

A display tray is formed by folding from an originally sheet-shaped body along respective weakened portions that subdivide the body into a plurality of central and lateral zones arranged in respective central and lateral columns and in respective rows corresponding to front, bottom, rear and intermediate regions of the tray as considered in a final condition of use of the tray. At least one sector is formed in two adjacent ones of the front, bottom and rear central zones that are interconnected by one of the weakened portions and extend substantially at right angles in the finished tray. The sector extends across the one weakened zone, being subdivided by it into two sector portions and is dissociated from each of the two central zones, but its portions remain connected to the respective ones of the two central zones for pivoting relative to them by respective auxiliary weakened portions. The auxiliary weakened portions extend at such angles relative to the one weakened portion that, as the two adjacent central zones are being moved toward their final positions with respect to one another, the sector portions are caused to move toward such positions relative to the two central zones that one of the sector portions extends into and across the space delimited by all of the zones in the finished tray and subdivides the same into respective compartments situated to the two sides of the one sector portion.

13 Claims, 6 Drawing Sheets

COMPARTMENTALIZED DISPLAY TRAY WITH ERECTABLE PARTITIONS

BACKGROUND OF THE INVENTION

1. Field of the Invention

The present invention relates to display arrangements in general, and more particularly to compartmentalized display trays capable of displaying the items being offered in an orderly and organized fashion.

2. Description of the Related Art

There are already known various constructions of display trays, among them such that include a plurality of partitions that subdivide the space bounded by the tray into a plurality of compartments each for accommodating merely a fraction of the total number of the items to be held on display. In some instances, like those involving beverage-containing boxes, the partitions are constituted by portions of interlocked mutually orthogonally extending cardboard sheets. In that case, however, the security with which the partitions hold the items in their assigned places is rather low due to the lack of connection of such sheets to the outer walls of the box, and diminishes further with the number of items already removed from the interior of the box. This, of course, is very disadvantageous.

To overcome this problem, it has also been proposed to connect the partitions to the walls bounding the space in which the items are to be accommodated. Invariably, though, this has been done in the past by providing the partitions as individual sheet-shaped members originally separate from the tray itself but equipped with respective mounting extensions, and by securing such mounting extensions to the respective tray walls by gluing, stapling or any other suitable fastening method.

Even though much better results as far as the positional stability of the partitions is concerned have been achieved by resorting to such an approach, experience has shown that it is also unduly laborious and cumbersome to perform, and hence considerably contributes to the final cost of the compartmentalized tray. It is the cost reasons that may have stood in the way of widespread acceptance and use of such compartmentalized trays, even though the need for them is clearly there.

OBJECTS OF THE INVENTION

Accordingly, it is a general object of the present invention to avoid the disadvantages of the prior art.

More particularly, it is an object of the present invention to provide a compartmentalized display tray that does not possess the drawbacks of the known display trays of the aforementioned type.

Still another object of the present invention is to devise a display tray of the type here under consideration which is capable of holding the items on display in predetermined positions and without accidental commingling by providing separate compartments for such items.

It is yet another object of the present invention to design the above display tray in such a manner as to not require any involved additional operations aimed at connecting any partitions to the outer walls of the tray.

A still further object of the present invention is to develop a display tray of the above type which can be easily folded into its final condition, with attendant movement of the partitions into their final positions as well.

A concomitant object of the present invention is so to construct the display tray of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display tray which includes an originally sheet-shaped body and means for subdividing the sheet-shaped body into a plurality of central and lateral zones arranged in respective central and lateral columns and in respective rows corresponding to front, bottom, rear and intermediate regions of the tray as considered in a final condition of use of the tray. The aforementioned subdividing means includes a multitude of weakened portions that interconnect respective adjacent ones of the zones with one another for pivoting between their initial positions in which all of the zones extend along one and the same plane, and their final positions assumed in the finished tray assuming its final condition.

In accordance with the present invention, there is further provided means for forming in two adjacent ones of the front, bottom and rear central zones that are interconnected by one of the weakened portions and extend substantially at right angles to one another in the finished tray at least one sector extending across the one weakened zone and subdivided by the latter into two sector portions. This sector is dissociated from each of the two central zones but its aforementioned portions remain connected to the respective ones of the two central zones for pivoting relative thereto by respective auxiliary weakened portions. These auxiliary weakened portions extend at such angles relative to the one weakened portion that, as the two adjacent central zones are being moved toward their final positions with respect to one another that they are to assume in the finished tray, the sector portions are caused to move toward such positions relative to the two central zones that one of the sector portions extends into and across the space delimited by all of the zones in the finished tray and subdivides the same into respective compartments situated to the two sides of the one sector portion.

A particular advantage of the present invention as described so far is that the sector portions, and hence the partition constituted by one of them, are constituted by integral parts of the same body as the aforementioned zones. This eliminates the previously existing need for a separate partition to one of such zones. Moreover, because the other of the sector portions acts as a sort of an anchor for the partition keeping it in its desired place, there is no need for providing another connection to the other of the adjacent walls either.

Advantageously, the two zones are those situated at the bottom and at the rear of the tray in its final condition. It is especially advantageous when the central zones include at least respective front, outer bottom, outer rear, inner rear and inner bottom central zones, with the inner and outer bottom central zones, and the inner and outer rear central zones, being juxtaposed with one another in the finished tray.

In this scenario, it is proposed for the two zones to be the inner bottom and the inner rear zones.

According to another facet of the present invention that applies in the last-mentioned situation, the sheet-shaped body includes at least one slot situated at that of the weakened portions that interconnects the front and outer bottom central zones with one another. Then, the inner bottom central zone is provided with at least one tab projecting beyond the rest of its outer periphery and into the slot in the finished tray to lock all of the central zones at least mediately in place.

In accordance with a further aspect of the present invention, the lateral zones include at least two that constitute respective outer side walls in the finished tray. In this context, it is particularly advantageous for the lateral zones to further include additional lateral zones constituting respective flaps that extend along at least the outer side walls in the finished tray to reinforce the same. The sheet-shaped body may advantageously further include at least one auxiliary slot at each of those weakened portions that connect respective ones of the additional lateral zones with the outer bottom central zone at the respective side of the finished tray. In this case, a further one of the additional lateral zones at each of the sides of the tray includes an auxiliary tab that extends into the auxiliary slot in the finished condition of the tray to lock all of the lateral zones situated at that side of the tray at least mediately in place.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
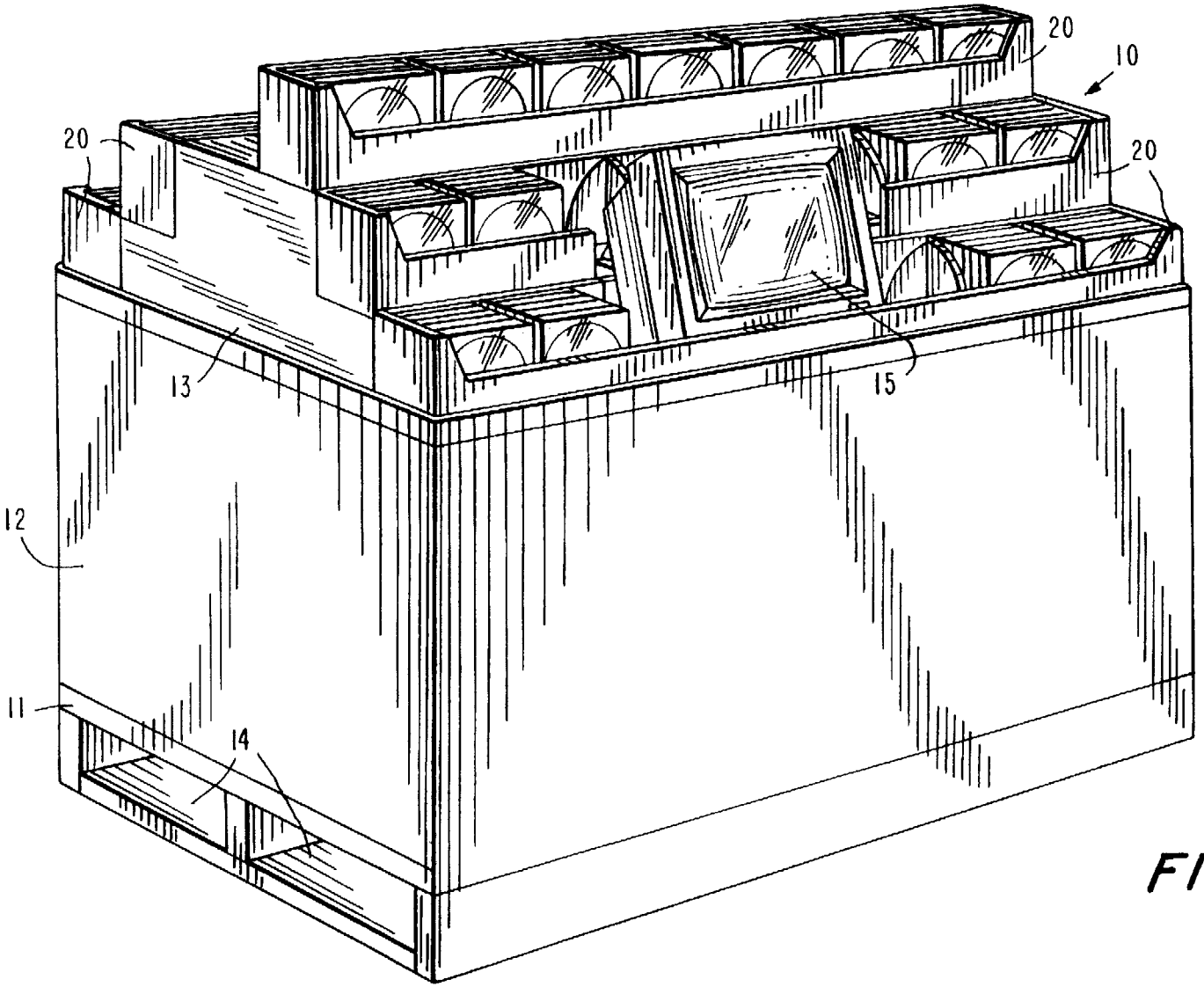
FIG. 1 is a perspective view of a support structure and of a plurality of subdivided display trays embodying the present invention that are supported in their desired positions on the support structure.

Referring now to the drawing in detail, and first to FIG. 1 thereof, it may be seen that the reference numeral 10 has been used therein to identify a supporting structure which, even though specifically designed or chosen for use in conjunction with the present invention, is not a part of the latter and hence will be discussed here only to the extent necessary for understanding the invention. The main reason for providing the supporting structure 10 is to serve as a support for a plurality of display trays that are all identified by the same reference numeral 20, without differentiating among them.

The supporting structure 10 is designed to support the trays 20 at elevations above the ground that are well suited for convenient access to the contents of the trays 20 by patrons of an establishment in which the support structure 10 is being used in that manner. To this end, the supporting structure 10 as illustrated includes a base 11, an intermediate piece 12 and a superstructure 13 that together bring the trays 20 to the desired levels. While these portions 11, 12 and 13 may be integral with one another, that is, be constituted by parts of a body made of the same material throughout, experience has shown that it is preferable to make them separate from each other, and possibly even of different materials, and to just assemble them with each other.

So, for instance, the base 11 may be constructed as a wooden pallet constituted by interconnected beams and/or slats that define respective channels for receiving the prongs of a forklift truck or a similar lifting and moving device when the assembly 11, 12 and 13 (possibly even with the filled trays 20 already supported on it) is to be transported or moved from one site or location to another, whereas the intermediate piece 12 may be of corrugated board, cardboard or a similar relatively low-weight but sturdy material, and the superstructure 13 may be once more of corrugated board, cardboard, or of another suitable material such as plywood or pressboard. It may be observed in FIG. 1 that the intermediate piece 12 and the superstructure 13 are shaped and dimensioned in such a manner as to form a plurality of steps for supporting the trays 20 in different tiers at locations that are staggered both horizontally and vertically, once more to give the customers quite unimpeded and rather convenient access to the contents of all of the trays 20.

In the application shown, the goods or items to be accommodated in the trays 20 for easy access to them by potential buyers are constituted by compact disks (CDS) in their respective containers or, as they are often called, "jewel cases". However, it will be appreciated that such items may be of a completely different character, such as books, audio or video tapes, tapes or even items having nothing in common with the entertainment industry or culture, such as prepackaged food, hardware, sewing notions, etc. Hence, the character of the items to be held on display in the trays 20, while not totally irrelevant, is of only marginal importance. What matters in the context of the present invention is that there is a desire or even need for the trays 20 to have a relatively large capacity (and hence dimensions, especially length) to accommodate as many of the items as can be conveniently handled during the transportation of the trays 20 and/or setup of the display, but at the same time to be compartmentalized into relatively small receiving recesses or bins to keep the items in some semblance of order and even possibly neatness and/or to minimize the extent of shifting of such items while the respective tray 20 is being moved from one location or site to another, and of commingling of such items of different character even after a prolonged exposure to the whims of members of the purchasing public who are not exactly generally known to exercise a great deal of care in returning items they have picked up for examination back to their original locations.

To complete the picture, it is to be mentioned at this juncture that the intermediate piece 12 may also support, as shown in FIG. 1, a television monitor or set 15 which may be used, either by itself or in combination with other audiovisual devices such as a video cassette recorder, to attract the attention of potential purchasers to the items being offered for sale and/or expose them to promotional, informative or instructional materials relating to such items. It goes without saying that, when such a TV set 15 is to be used, one or (usually) more of the trays 20 and/or the superstructure 13 will have to be modified to provide the room for accommodating the set 15. This, however, does not change anything on or detract in any manner from the principles of construction, formation and use of the trays 20 as they will be explained below.

Figure 2:
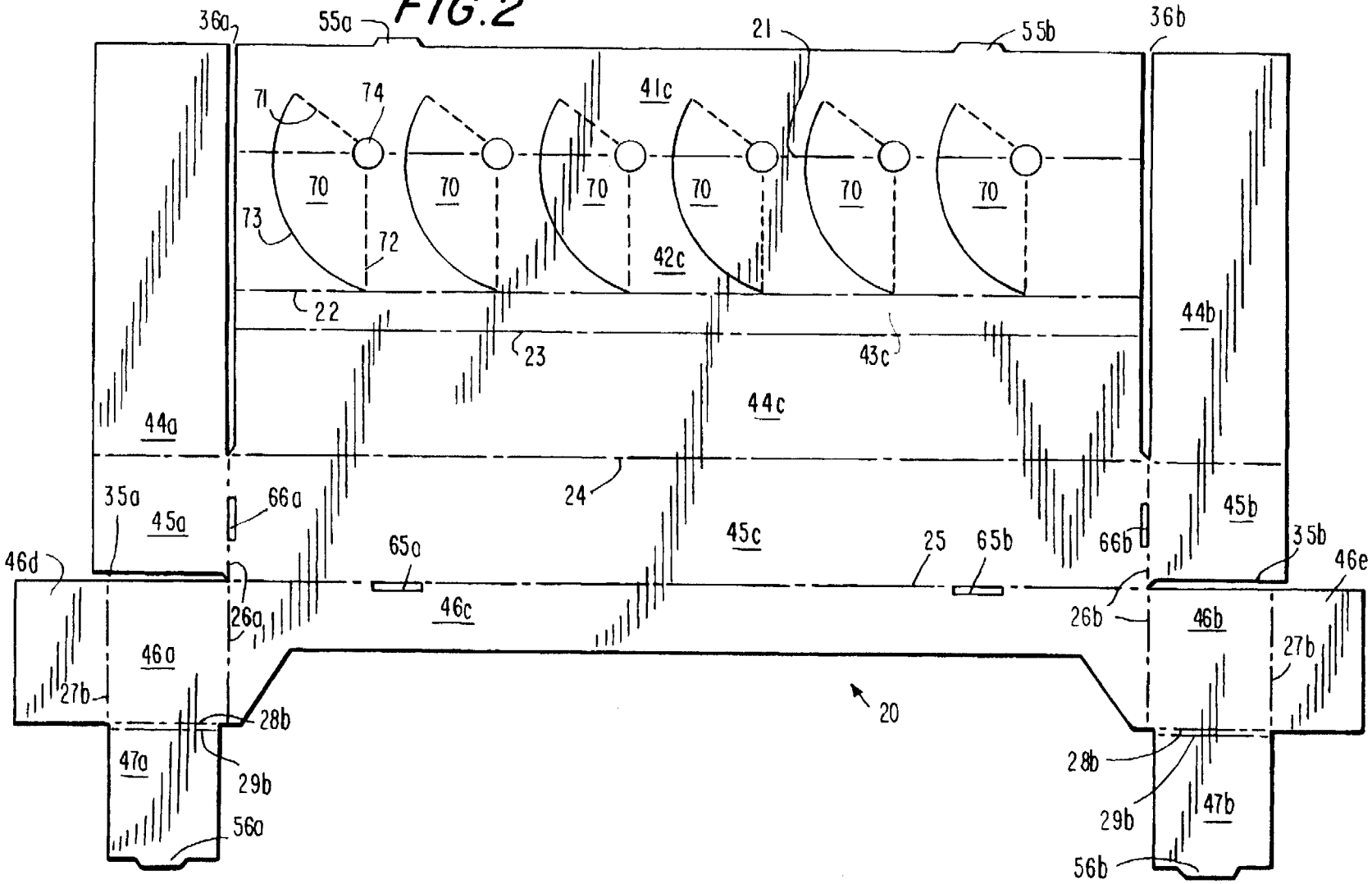
FIG. 2 is a view of a precursor of one of the display trays shown in FIG. 1 in its preform state in which it is fully developed into the plane of the drawing and which it assumes prior to being folded into the final tray, on a scale exceeding that of FIG. 1.

The various portions and features of the tray 20 are readily discernible in FIG. 2 that depicts the tray 20 not in its final form, but in its precursor state in which its various portions are all developed into the plane of the drawing. This is also the initial state of the tray preform 20, that is the state it is in right after it has been produced by cutting from a sheet of corrugated board, cardboard or a similar relatively stiff material. The tray preform 20 is also provided in the course of its manufacture with various fold or crease lines or weakened portions 21 to 25, as well as 26 to 29 each supplemented with a suffix a if situated on the left side and b when on the right.

This convention regarding the suffixes used in dependence on the locations of the affected regions will be adhered to throughout the drawing and also in this description except that, where the statements presented are equally applicable regardless of whether the formations in question are located on the right or on the left and how far from the center, the affected suffixes will be omitted, meaning that the formations will be referred by their basic reference numerals alone. Using the above convention, the tray preform 20 further includes, in addition to the crease lines 21 to 29, respective cuts or slits 35 and 36 forming respective continuations of the aforementioned crease lines 25 and 26, respectively.

The crease lines 21 to 29 and the cuts 35 and 36 subdivide the tray preform 20 into a plurality of walls or zones that have been assigned reference numerals 41 to 47 based on their at least partial location within a particular "row", and suffixes a to e based on their locations within particular lateral and central "columns", with the suffix c denoting a central column, and suffixes d and e additional lateral columns outwardly adjoining the lateral columns a and b, respectively. It will be appreciated that the various zones 41 to 47 of the tray preform 20 can be pivoted and/or folded relative to one another about, and within the bounds permitted by, the respective crease lines/cuts 21 to 29, 35 and 36 situated between them, and actually are so pivoted during the conversion of the preform into the final tray 20.

It is further to be mentioned at this juncture that the preform 20 is further provided with respective slots 65 and 66 located in or at the crease lines 25 and 26, respectively, as well as and with corresponding tabs 55 and 56 situated at the outer periphery of the tray preform 20, and more particularly on the zones 41 and 47. Where exactly the aforementioned zones 41 to 47 and tabs 55 and 56 go as the conversion is being accomplished will be explained as the present description proceeds and/or become readily apparent from the drawing itself.

It may also be seen in FIG. 2 that the central zones 41*c* and 42*c* are provided with a plurality of (as shown six) sectors that are all identified, without differentiating between them, by the reference numeral 70. As indicated with respect to the leftmost one of them, the sectors 70, which span or extend between the zones 41*c* and 42*c*, are joined to them by respective auxiliary radial crease lines 71 and 72, but also separated from them by respective arcuate incisions 73. It will be appreciated that the auxiliary crease lines 71 and 72 not only permit the sectors 70 to behave differently from the remainder of the zones 41*c* and 42*c* by permitting the adjacent regions of the respective sector 70 to be displaced out of the plane of the respective associated central zone 41*c* or 42*c*, as the case may be, but frequently even promote or cause such an out-of-plane lifting. Why this is so should become evident from observing the not yet discussed FIGS. of the drawing. Before turning to them, though, it is still to be mentioned that an aperture 74 (as shown a round one) is provided at and around the area where the crease lines 21, 71 and 72 would otherwise meet. The provision of this aperture 74 further facilitates and/or enhances the aforementioned lifting by eliminating areas of occurrence of concentrated stresses due to material compression that would oppose such out-of-plane movement.

Figure 3:
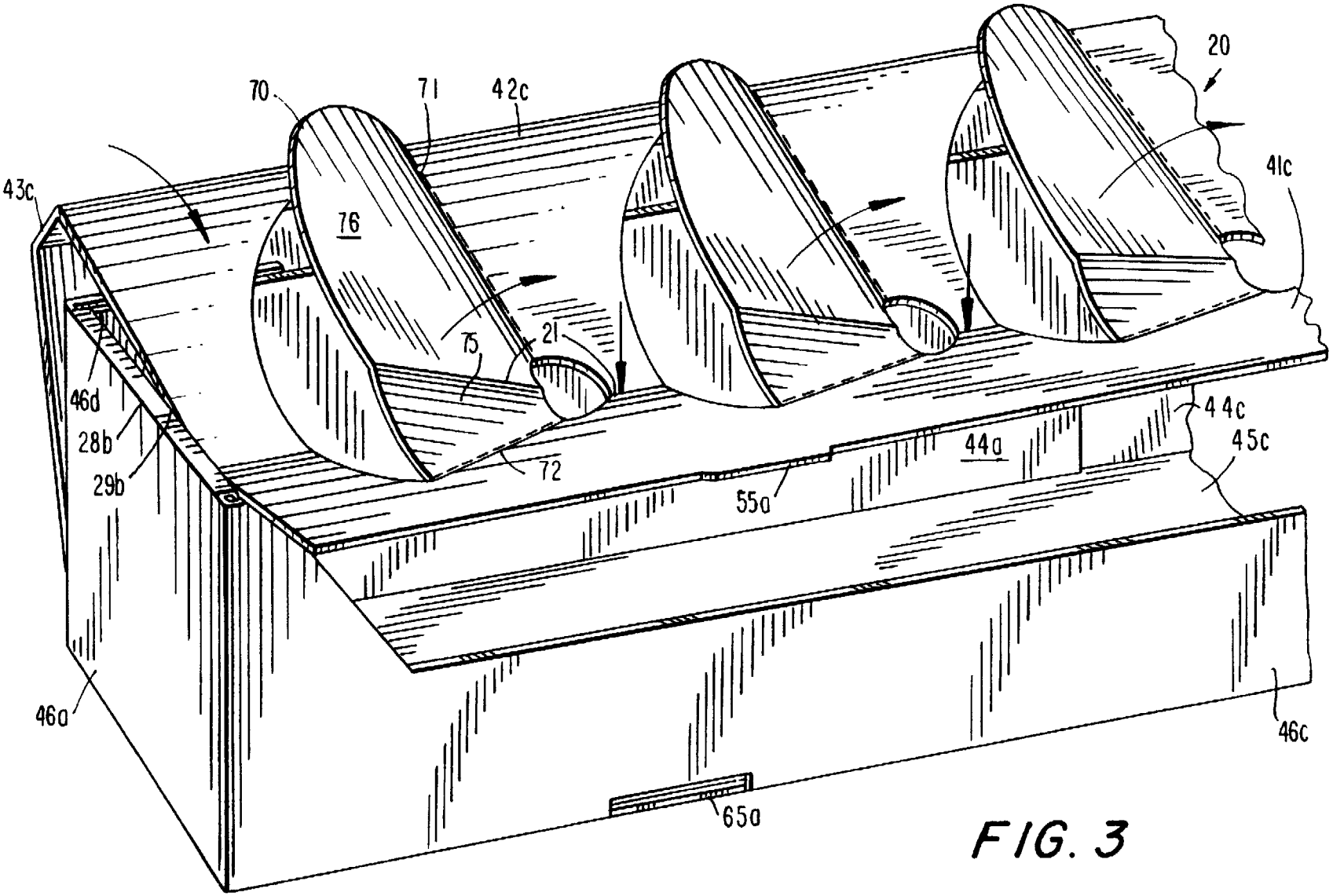
FIG. 3 is a perspective view of a portion of the tray preform depicted in FIG. 2 taken in the course of its transformation into a finished tray by folding along various creases and cuts provided therein, drawn to a scale exceeding that of that of FIG. 2.

Turning the attention to FIG. 3 of the drawing now, it is to be mentioned that it reveals just the left side of the display tray 20 in an advanced but not yet completed stage of its formation from the aforementioned precursor, with the arrows appearing there indicating the further movement of the various parts of the tray 20 toward their final positions. It should be mentioned here, even though it should go without saying, that similar conditions to those depicted in FIG. 3 prevail, not necessarily but preferably substantially simultaneously, at the other side (the b side) of the tray 20 as well, so that they need not be specifically addressed here or hereafter. It will be realized that the zones 46*c*, 46*a*, 45*c* and 44*c* that are to respectively constitute the outer front, side, bottom and rear walls of the finished tray 20 are already in their final positions or quite close to it in this illustration, as are the zones or flaps 44*a* located in front of the rear wall 44*c*, and 46*d* situated between the rear wall 44*c* and the flap 44*a*, as well as those that cannot be seen because they are located next to and to the right of the side wall 46*a* and hence are obscured by the latter, namely the region or flap 47*a* the location of which is indicated by the positions of the double hinges or crease lines 28*a* and 29*a*, and the flap 45*a* that is confined between the side wall 46*a* and the flap 47*a*.

FIG. 3 also illustrates that, as the zones 44*c*, 43*c*, 42*c* and 41*c* approach their final destinations in which the zone 41*c* is substantially conformingly interiorly juxtaposed with the bottom wall 45*c* and the zone 42*c* with the rear wall 44*c* (with the flaps 46*a* and 44*a* intervening, and the zone 43 spanning their top portions), and as the zones 41*c* and 42*c* are moved relative to one another into positions reminiscent of the letter V, respective portions 75 and 76 jointly constituting the sectors 70 are simultaneously moved about the respective crease lines 21, 71 and 72 out of their original coplanar positions with the zones 41*c* and 42*c* into their positions more and more resembling the letter A. While this so-to-say inverted movement of the portions 75 and 76 with respect to their respective associated zones 41*c* and 42*c* in most instances occurs automatically and without any human intervention, in some cases it may be necessary for the person forming the tray 20 from the preform to initially displace the portions 75 and 76 ever so slightly into their over-the-dead-center positions. However, even in those quite rare instances in which this initializing action is required, the further movement of the portions 75 and 76 proceeds automatically.

Figure 4:
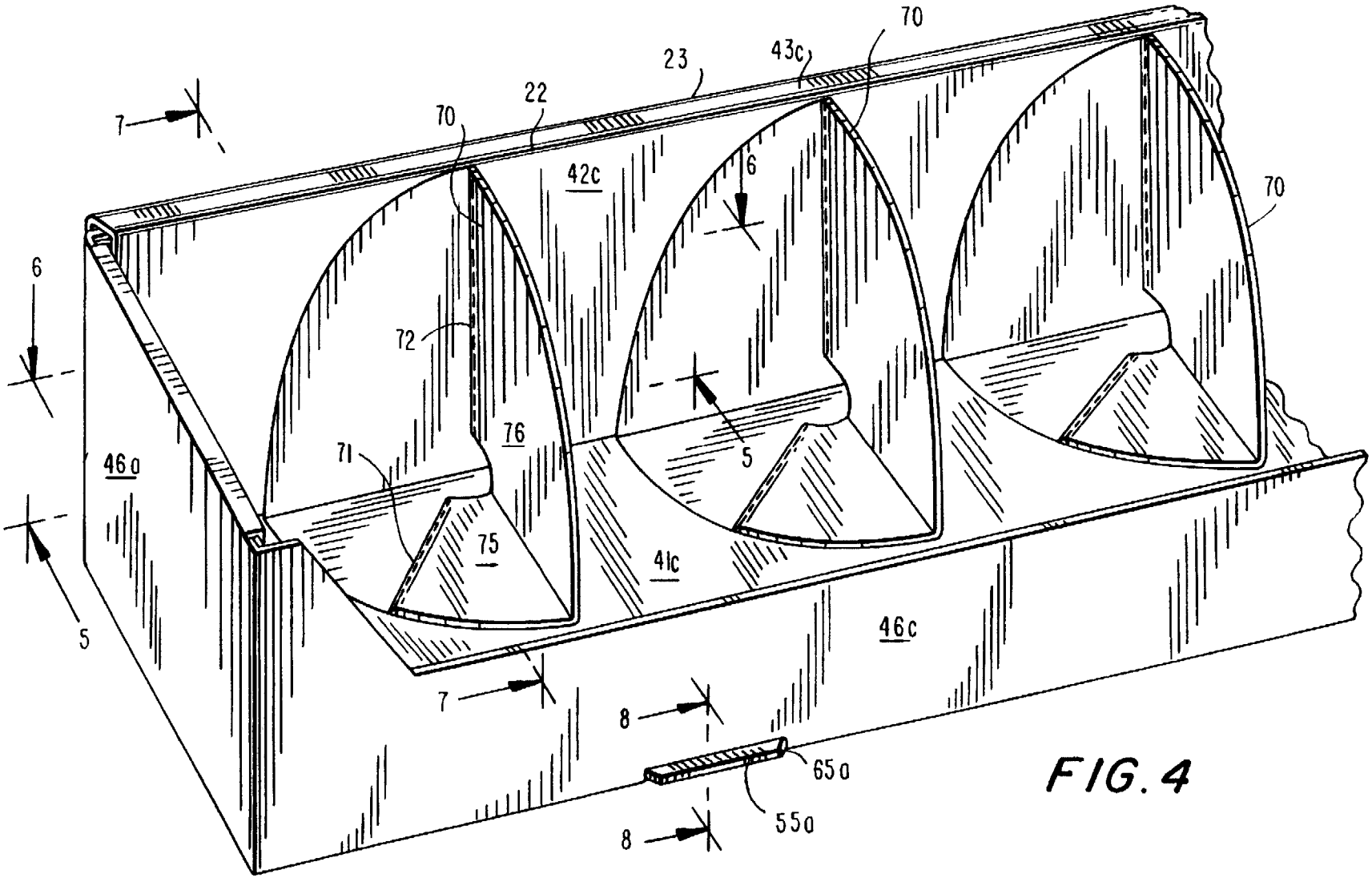
FIG. 4 is a view similar to that of FIG. 3 but showing the tray in its finished form.
Figure 5:
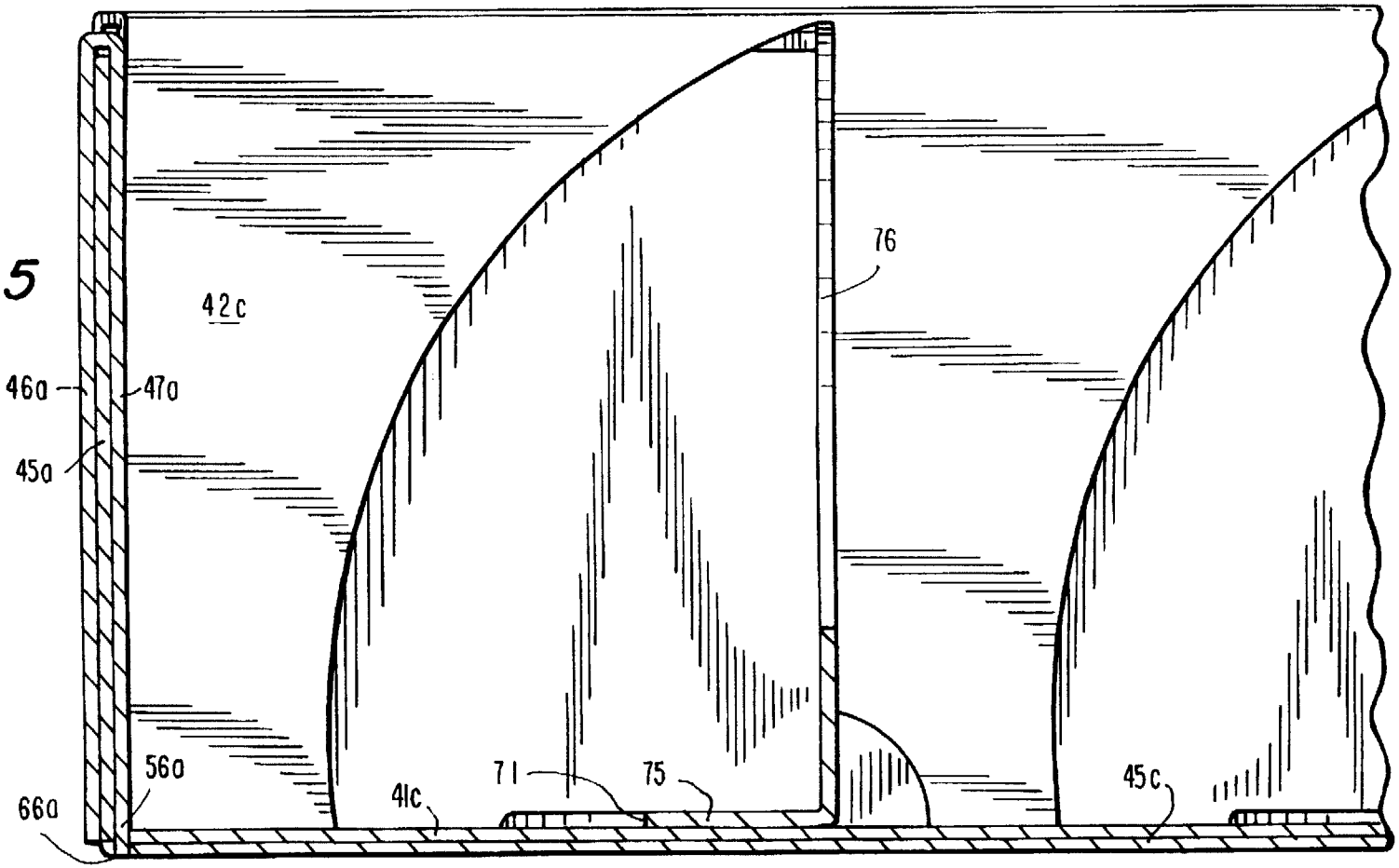
FIG. 5 is sectional view, on a scale still further exceeding those of all of FIGS. 1 to 4 and essentially corresponding to the actual conditions, taken on line 5—5 of FIG. 4.

The final stage of the formation of the display stand is depicted in FIG. 4 of the drawing. As shown there, once more with respect to the leftmost one of the sections 70 only, the portion 75 lies substantially flat back on top of the rest of the inner bottom flap 41*c*, whereas the portion 76 juts out of its originating zone 42*c*, preferably at right angles thereto. It will be appreciated, though, that while in most instances this orthogonal arrangement of the portion 76 with respect to the zone 42*c* will be the one desired, there is nothing to prevent the angle in question from being chosen, either for all or for just some of the sectors 70, to differ from this value. That can be easily achieved, but it must be done in the process of manufacturing the tray preform 20, since it is the acute angle which the crease line 71 includes with the crease line 21 that determines (at substantially double its value) the angle at which the portion 76 extends relative to the inner back wall or zone 42*c*. It will certainly be appreciated that the thus extending portions 76 constitute respective partitions that subdivide the space bounded by the tray 20 into a plurality of individual compartments each for accommodating a different set or group of the aforementioned items.

Figure 6:
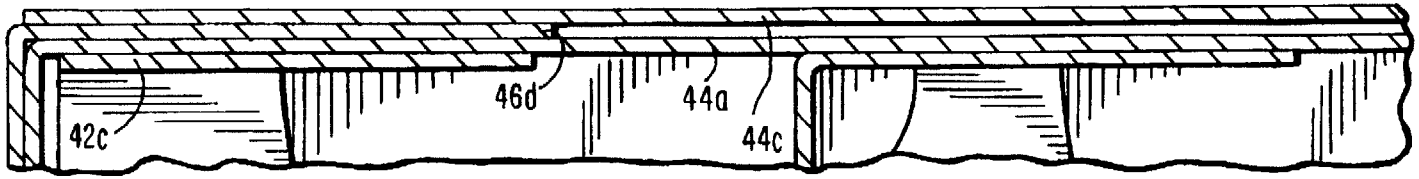
FIG. 6 is another sectional view akin to that of FIG. 5 but taken along lines 6—6 of FIG. 4.

The remaining FIGS. 5 to 8 of the drawings show in some detail certain features and mutual positions and cooperation of the various parts of the tray 20 in its finished condition. So, for instance, it may be perceived from FIG. 5 not only that the portion 76 indeed extends substantially perpendicularly to the inner back wall 42*c* in this currently preferred embodiment of the present invention, but also that the zone or flap 45*a* is indeed received between the side wall 46*a* and the inner flap 47*a*. Moreover, it is also shown there that the tab 56*a* is received or engages in the slot 66*a* and hence locks the flap 47*a*, and with it the flap 45*a* and even the side wall 46*a*, in place. FIG. 6, on the other hand, confirms the aforementioned confinement of the flaps 46*d* and 44*a*, in that order, between the outer and inner rear walls 44*c* and 42*c*.

Figure 7:
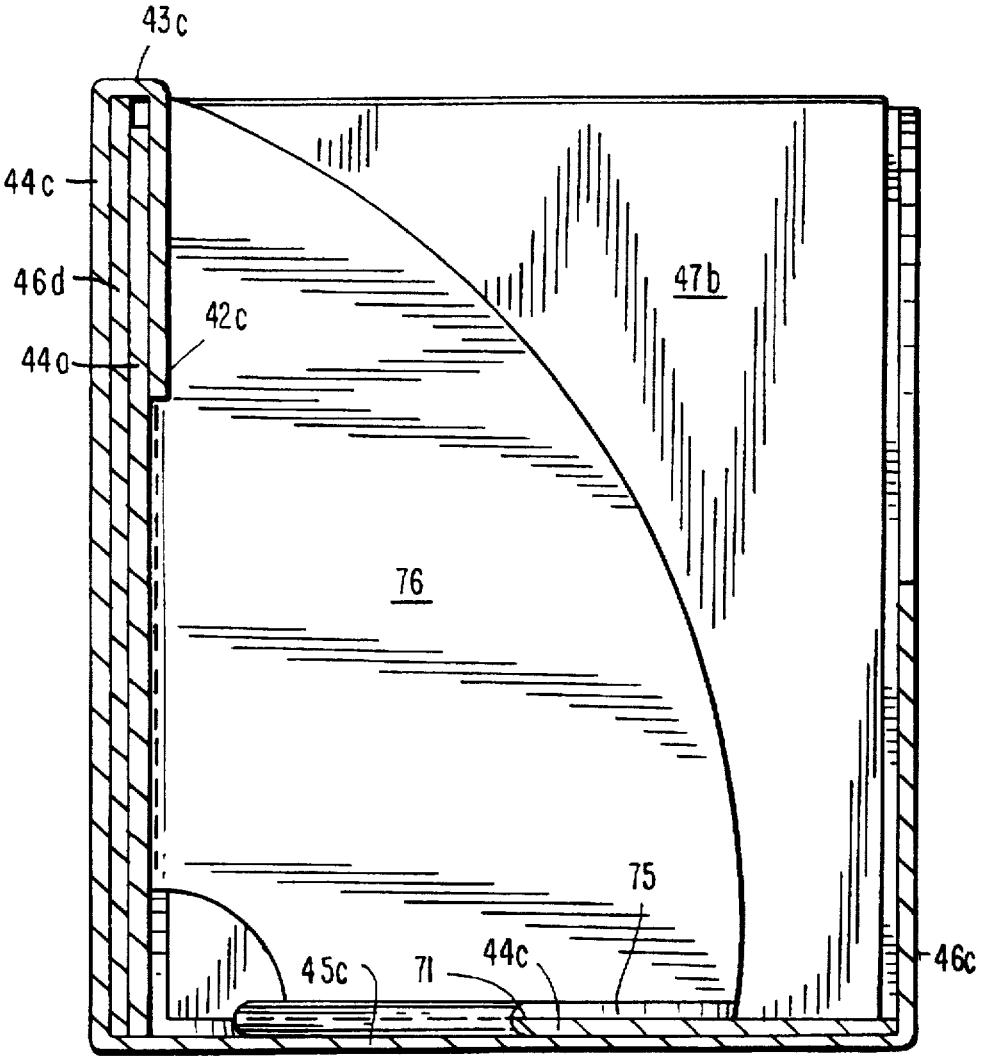
FIG. 7 is a cross-sectional view substantially on the same scale as FIGS. 5 and 6, taken at the plane indicated by the arrows 7—7 in FIG. 4.
Figure 8:
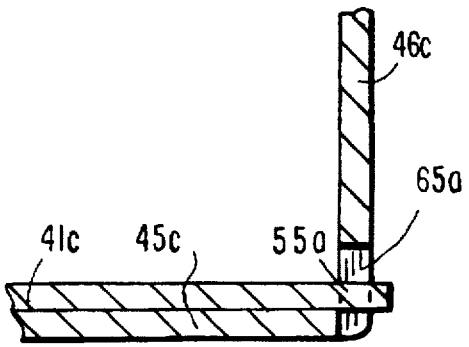
FIG. 8 is a view like that of FIG. 7 but taken at the plane 8—8 of FIG. 4 to show only a fraction of the cross section of the finished tray.

FIG. 7 of the drawing provides another confirmation of and insight into the relative positions of the zones 44*c*, 46*d*, 44*a* and 42*c*, as well as of the position of the portion 76 relative to the zone 42*c* and of the portion 75 relative to the zone 41*c*. Last but not least, FIG. 8 of the drawing reveals that, in the final assembled condition of the tray 20, the tab 55*a* extends into and engages in the slot 65*a*, thus locking the inner bottom wall 41*c* in its juxtaposed position with the outer bottom wall 45*c*, and, as a consequence, the outer and inner rear walls 44*c* and 42*c* and the flaps 46*d* and 44*a* confined between them, in their proper positions.

It will be understood that each of the elements described above, or two or more together, may also find a useful application in other types of constructions differing from the type described above.

While the present invention has been described and illustrated herein as embodied in a specific construction of a compartmentalized tray for CDS and the like, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A display tray comprising:

a) a pair of generally planar shelf walls foldable about a fold line between an initial position in which said shelf walls are generally co-planar, and a final position in which said shelf walls are generally orthogonal to, and bound a space with, each other, b) an incision extending across said fold line between said shelf walls, c) a pair of radial crease lines, one in each said shelf wall, each crease line extending from said incision toward said fold line to bound therewith a respective sector portion in each said shelf wall, d) said sector portion in one of said shelf walls pivoting about said crease line in said one shelf wall during folding of said walls to overlie said one shelf wall in said final position, e) said sector portion in the other of said shelf walls pivoting about said crease line in said other shelf wall during said folding to extend in a generally erect state with said other shelf wall and constitute a partition that subdivides said space into respective compartments situated on opposite sides of said partition, f) a pair of generally planar side walls generally co-planar with said shelf walls in said initial position, and generally parallel to said partition in said final position, g) a pair of generally planar front and rear walls generally co-planar with said shelf walls in said initial position, and generally parallel to said other shelf wall in said final position, h) a generally planar base wall generally co-planar with said shelf walls in said initial position, and generally parallel to said one shelf wall in said final position, and i) a lock for releasably holding all of said walls in said final position.

2. The display tray as defined in claim 1, wherein said shelf walls are elongated along a longitudinal direction; and further comprising a plurality of said incisions spaced apart along the longitudinal direction, and a plurality of pairs of said radial crease lines spaced apart along the longitudinal direction together forming a plurality of said partitions spaced apart along the longitudinal direction, all of said partitions being simultaneously erectable to said erect state.

3. The display tray as defined in claim 1, wherein said sector portions are generally orthogonal to each other in the final position.

4. The display tray as defined in claim 1, wherein the lock includes slots on one of said walls, and tabs on another of said walls, said slots receiving said tabs to maintain all of said walls in said final position.

5. The display tray as defined in claim 1, wherein all of said walls are constituted of a single, unitary sheet-shaped material.

6. A display tray comprising:

a) an originally sheet-shaped body;

b) means for subdividing said sheet-shaped body into a plurality of central and lateral zones arranged in respective central and lateral columns and in respective rows corresponding to front, bottom, rear and intermediate regions of the tray as considered in a final condition of use of the tray, said subdividing means including a multitude of weakened portions that interconnect respective adjacent ones of said zones with one another for pivoting between their initial positions in which all of said zones extend along one and the same plane, and their final positions assumed in the finished tray assuming said final condition thereof, said central zones including at least respective front, outer bottom, outer rear, inner rear and inner bottom central zones, with said inner and outer bottom central zones, and said inner and outer rear central zones, being juxtaposed with one another in the finished tray, said lateral zones including at least two that constitute respective outer side walls in the finished tray; and c) means for forming in two adjacent ones of said front, bottom and rear central zones that are interconnected by one of said weakened portions and extend substantially at right angles to one another in the finished tray, at least one sector extending across said one weakened zone and subdivided by the latter into two sector portions, said sector being dissociated from each of said two central zones but said sector portions remaining connected to the respective ones of said two central zones for pivoting relative thereto by respective auxiliary weakened portions, said auxiliary weakened portions extending at such angles relative to said one weakened portion that, as said two adjacent central zones are being moved toward their final positions with respect to one another that they are to assume in the finished tray, said sector portions are caused to move toward such positions relative to said two central zones that one of said sector portions extends into and across the space delimited by all of said zones in the finished tray to form a partition that subdivides the finished tray into respective compartments situated to the two sides of said one sector portion.

7. The display tray as defined in claim 6, wherein said two zones are those situated at the bottom and at the rear of said tray in said final condition thereof.

8. The display tray as defined in claim 6, wherein said two zones are said inner bottom and said inner rear zones.

9. The display tray as defined in claim 6, wherein said sheet-shaped body includes at least one slot situated at that of said weakened portions which interconnects said front and outer bottom central zones with one another; and wherein said inner bottom central zone includes at least one tab projecting beyond the rest of its outer periphery and into said slot in the finished tray to lock all of said central zones at least mediately in place.

10. The display tray as defined in claim 6, wherein said lateral zones further include additional lateral zones constituting respective flaps that extend along at least said outer side walls in the finished tray to reinforce the same.

11. The display stand as defined in claim 10, wherein said sheet-shaped body further includes at least one auxiliary slot at each of those weakened portions that connect respective ones of said additional lateral zones with said outer bottom central zone at the respective side of the finished tray; and wherein a further one of said additional lateral zones at each of the sides of the tray includes an auxiliary tab that extends into said auxiliary slot in said finished condition of the tray to lock all of said lateral zones situated at that side of the tray at least mediately in place.

12. The display tray as defined in claim 6, wherein said forming means is operative for forming a plurality of partitions spaced along a longitudinal direction apart from one another, all of said partitions being simultaneously erectable to subdivide the finished tray into multiple compartments.

13. The display tray as defined in claim 6, wherein said bottom central zone is generally planar for lying in supporting engagement with a support surface of a display stand.

* * * * *